United States Patent [19]

Hruby et al.

[11] 4,394,988

[45] Jul. 26, 1983

[54] ARRANGEMENT FOR CONSTANT FEEDING OF YARN

[75] Inventors: Jan Hruby, Svornosti; Karel Pleskac, Jiraskova, both of Czechoslovakia

[73] Assignee: Zbrojovka Vsetin, narodni podnik, Vsetin, Czechoslovakia

[21] Appl. No.: 212,429

[22] Filed: Dec. 3, 1980

[30] Foreign Application Priority Data

Dec. 3, 1979 [CS] Czechoslovakia ..... 8322/79
Jun. 6, 1980 [CS] Czechoslovakia ..... 4006/80

[51] Int. Cl.[3] ..... B65H 51/22
[52] U.S. Cl. ..... 242/47.12
[58] Field of Search ..... 242/47.12, 47.13, 47.01; 66/132 R; 139/452; 192/67 R, 95

[56] References Cited

U.S. PATENT DOCUMENTS

| | | | |
|---|---|---|---|
| 1,074,959 | 10/1913 | Kreiling | 192/95 UX |
| 2,684,142 | 7/1954 | Willyard et al. | 192/67 R |
| 2,727,406 | 12/1955 | Opocensky | 192/67 R X |
| 2,735,528 | 2/1956 | Dodge | 192/67 R X |
| 2,841,454 | 7/1958 | Cheramie | 192/67 R X |
| 3,419,225 | 12/1968 | Rosen | 242/47.12 |
| 3,709,444 | 1/1973 | Tannert | 242/47.12 X |
| 3,791,598 | 2/1974 | Vischiani et al. | 242/47.12 |
| 3,796,384 | 3/1974 | Rosen | 242/47.12 |
| 3,796,386 | 3/1974 | Tannert | 242/47.12 |
| 3,827,645 | 8/1974 | Rosen | 242/47.12 |
| 4,039,155 | 8/1977 | Jacobsson | 242/47.12 |
| 4,047,675 | 9/1977 | Jacobsson | 242/47.12 X |
| 4,121,782 | 10/1978 | Shelton | 242/47.12 |
| 4,235,388 | 11/1980 | Jacobsson | 242/47.01 |

*Primary Examiner*—Stanley N. Gilreath

[57] ABSTRACT

Arrangement for the constant feeding of yarn to textile machines. The arrangement has a cage drum the circumference of which is composed of stable bolts; between the stable bolts there are disposed elements adapted to be shifted in the direction of the axis of rotation of the drum. The shiftable elements adjust the position of yarn windings wound-on on the cage drum.

4 Claims, 6 Drawing Figures

16
26
25
46
33
20
21
22
5
23
24
5
6
8
4
3

ARRANGEMENT FOR CONSTANT FEEDING OF YARN

BACKGROUND OF THE INVENTION

The invention relates to an arrangement for constant feeding of yarn to textile machines, particularly to knitting machines, where a continuously constant amount of yarn supplied to the operating system is required. The arrangement comprises a cage drum provided on its circumference with stable bolts, whereon a number of yarn windings are wound on, with a device for shifting these windings on the cage drum.

One of the known arrangements for the constant feeding of yarn comprises a system of rotatably arranged feeding rollers distributed along the circumference of a knitting machine and guiding an endless band driven by the drive of the machine. The proper feeding of yarn to the knitting system is accomplished by taking along the yarn between the endless band and a roller. As there is contact of the yarn with the feeding band on a small section only, the yarn slides, resulting in different speeds of the feeding band and thus also of the supplied yarn, so that the consumption of yarn is not uniform for all systems of the knitting machine. A consequence thereof is that the manufactured knitted goods are not uniform and their quality is lower.

A feeding arrangement is furthermore known wherein two endless feeding bands, one on the other, are guided by a system of rollers. The yarn is supplied between these feeding bands. A drawback of this solution is a considerable length of the internal feeding band, causing its delay and thus also non-uniform amounts of supplied yarn, particularly in the course of the starting and stopping of the machine.

Another known arrangement has for each feeding roller a coordinated auxiliary roller, whereby an individual feeding band encompasses both said rollers, the supplied yarn being taken along at given places between both bands. An advantage of this arrangement is a reduced possibility of the winding-on of a torn yarn on the feeding roller; otherwise this arrangement has the same drawbacks as the afore-mentioned arrangements.

Many of these mentioned drawbacks are eliminated in feeding arrangements where each feeding head is made so as to permit the winding of several windings of yarn on its drum, as is, for instance, described in the specification of an author's certificate of an invention of the USSR No. 519,513. In another similar solution, the deposition of these windings and their subsequent shifting is accomplished on a head with a cage drum, for instance by means of an inclined shifting sheet or by an indented wheel. There is, however, a rather high friction when shifting the yarn.

The same drawback is experienced when using two bolt cages, one stable, the other performing an axial and radial movement, as is, for instance, described in published German patent specification DAS No. 1,967,177.

Another known arrangement uses for the depositing and shifting of yarn windings an inclined arranged conical toothed wheel engaging with its teeth with bolts on the circumference of a feeding roller, on which yarn windings are deposited. The toothed wheel constantly shifts the yarn windings by the lateral face of its teeth. A drawback of this solution is that the movements of the toothed wheel and of the yarn from the axial and radial direction are added, causing a substantial abrasion of the yarn. The small diameter of the conical toothed wheel required by the construction causes a shifting of the yarn on a rather short, almost point section, causing a relatively high stress of the yarn on a small part of the circumference of the feeding roller.

SUMMARY OF THE INVENTION

It is an object of this invention to eliminate or at least substantially reduce the above-mentioned drawbacks of existing systems for the constant feeding of yarn to textile machines. The invention achieves such object by the provision of an arrangement having on each cage drum several complete windings of yarn, the circumference of which drum being formed by bolts firmly inserted into the body of feeding head, whereby between the stable bolts of the circumference of the cage drum elements are alternately provided which are adapted to be shifted in the direction of the axis of the drum.

The axially shiftable elements can be, for instance, rollers, the middle part of which is recessed to a smaller diameter, so that internal faces for the distribution of yarn are formed on the circumference of the cage drum with stable bolts, whereby said rollers bear by their extreme faces against a stable face cam which is firmly connected to a bolt affixed on the frame of a textile machine.

In order to reduce the friction of the yarn on the bolts of the cage drum, a clearance is provided between the surface of the middle part of the axially shiftable rollers and a line connecting the external surfaces of adjacent stable bolts of the cage drum.

It is advantageous if the external surfaces of axially shiftable elements determine an imaginary enveloping diameter larger than the enveloping diameter around the stable bolts for the winding-on of yarn on the rotary cage drum, whereas the axially shiftable elements cooperate by their recesses with the circumferential part of a control disk rotatably supported on a stable flange so that its geometrical axis is askew with respect to the rotation axis of this control disk and thus also with the axis of rotation of the cage drum. The cage drum is composed of bodies fixed on a shaft for instance by a feather key and a screw; the control disk is taken along by a bolt inserted in the body of the rotary cage drum, and a manually controlled coupling is inserted into the drive of the rotary cage drum.

The operation is smoother if the axially shiftable elements are provided with a recess, into which a control disk is supported rotatably on a stable flange engaged by its circumference, whereby its geometrical axis is askew with respect to the rotation axis of the rotary cage drum.

The manually controlled coupling advantageously consists of a hand wheel, in the opening of which a radial groove is provided and in a transverse bore of the shaft at least two balls are situated, the balls being mutually spaced by a spring, the contact faces of a driven pulley and of the hand wheel being provided with a radial indentment. The coupling permits a better manipulation when introducing and winding on a certain number of yarn windings on the cage drum.

The movement of the axially shiftable elements can also be generated by a stable face cam, which engages by its circumference into a recess of individual axially shiftable elements.

Advantages of the arrangement according to this invention are that it insures a constant low stress of yarn supplied to the operating system of a textile machine even at high rotating speeds, and that no failures occur when depositing yarn on the rotating cage drum. Due to the relatively low stress of the yarn at its off-take, the stress on needless and thus also their wear is reduced. In a specific case, the need of knitting needles at a knitting machine of large diameter has been reduced by 15%. Another advantage of the arrangement according to this invention is that it can be utilized both for clockwise and counterclockwise rotating textile machines while processing all kinds of yarn.

DESCRIPTION OF THE DRAWINGS

Examplary embodiments of arrangements according to this invention are shown in the attached drawings, wherein.

DESCRIPTION OF PREFERRED EMBODIMENTS

Figure 1:
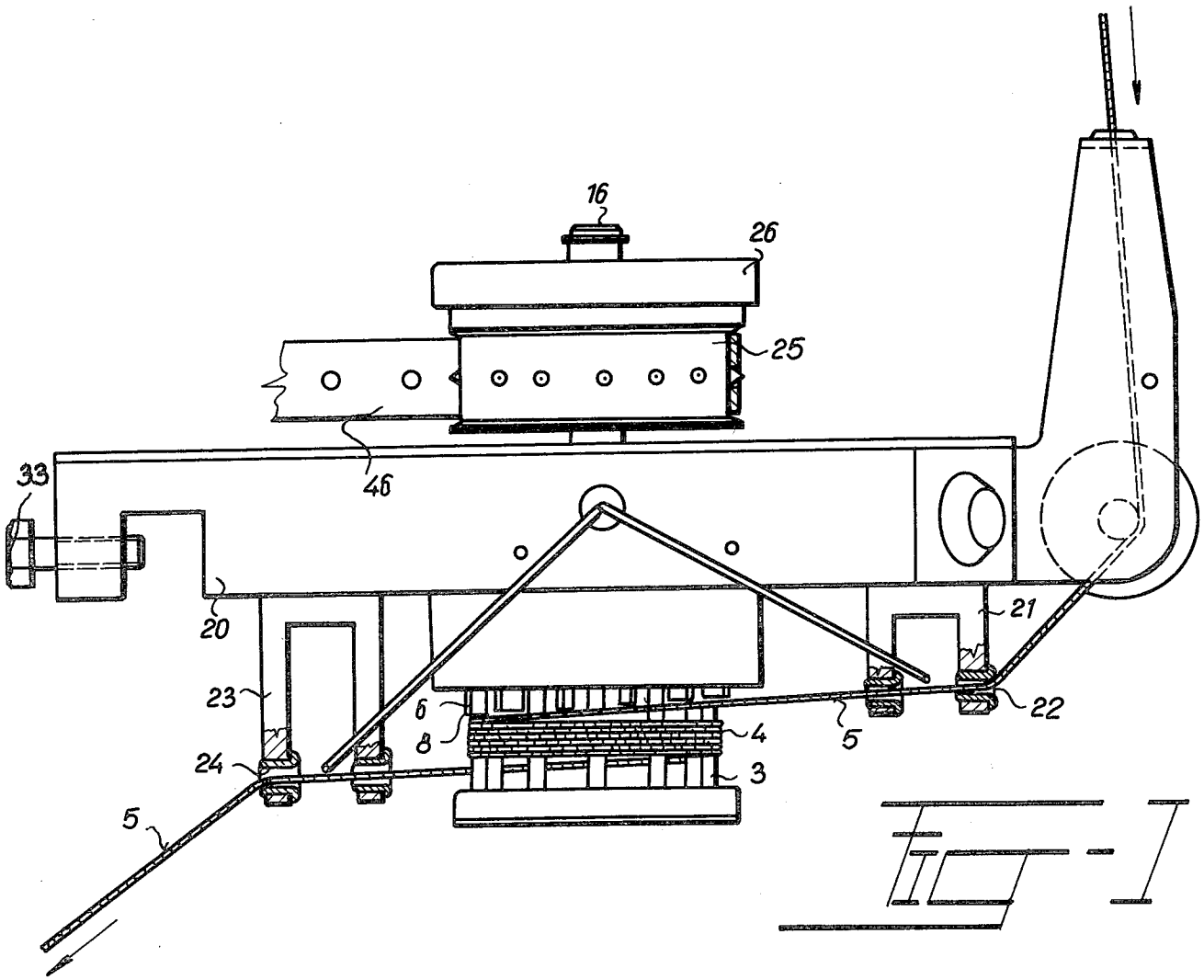
FIG. 1 is an overall view in elevation of a first arrangement situated on a machine.
Figure 2:
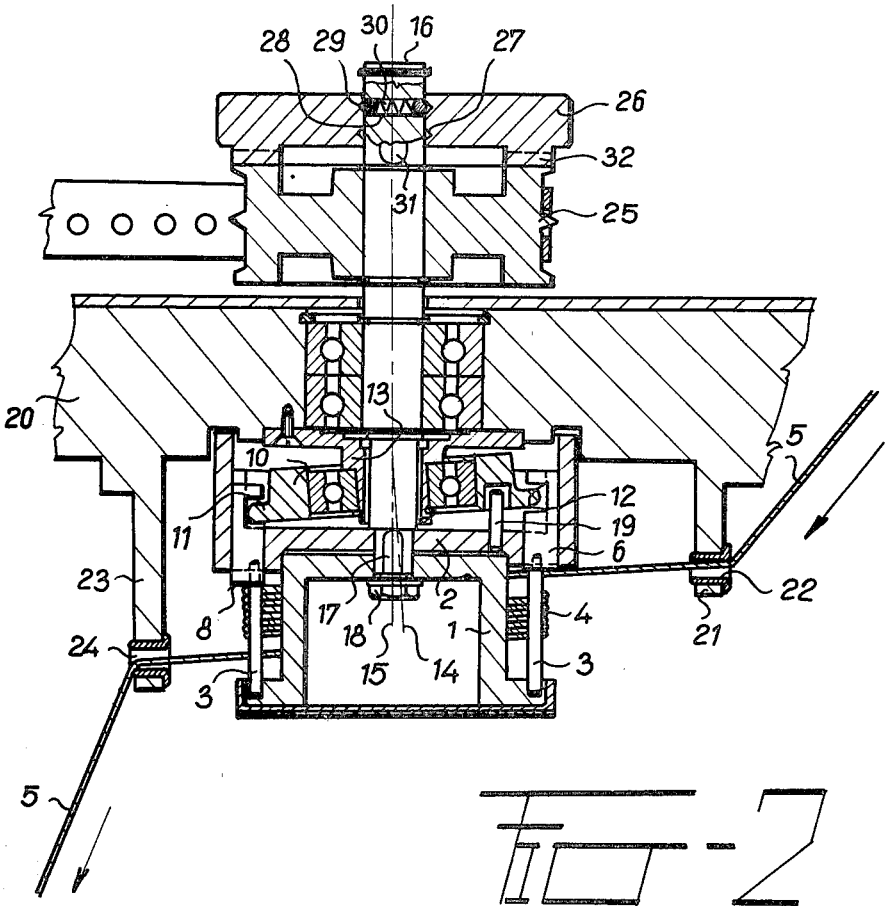
FIG. 2 is a sectional elevation of the feeding head of the arrangement of FIG. 1.
Figure 3:
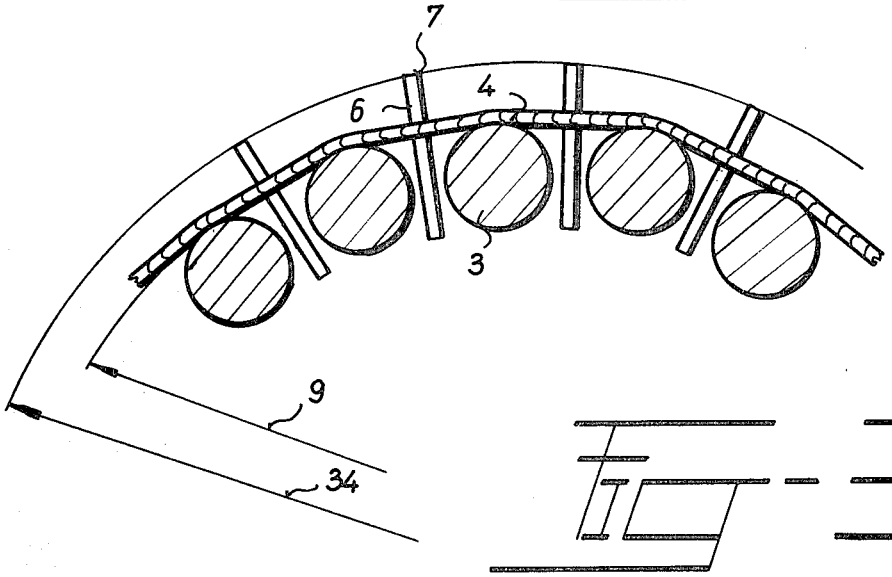
FIG. 3 is a top plan view of a detail of the mutual spatial arrangement of stable bolts and axially shiftable elements, the imaginary enveloping diameter of which is larger than the imaginary enveloping diameter of the stable bolts.

Turning first to the embodiment of FIGS. 1, 2, and 3, the main part of the arrangement according to this embodiment of the invention is a cage drum consisting of bodies 1 and 2 (see FIG. 2) in which bodies rods or bolts 3 are firmly inserted, bolts 3 forming the circumference of the rotary cage drum for winding-on and depositing windings 4 of yarn 5 and at the same time also determine an imaginary enveloping diameter 9 (FIG. 3) of the drum. Axially shiftable elements 6 determining by their external surfaces 7 (FIG. 3) an imaginary enveloping diameter 34 which is larger than the imaginary enveloping diameter 9 are situated between these stable bolts 3 parallel with the rotation axis 15 (FIG. 2), the axially outer edges 8 of the axially shiftable elements 6 simultaneously adjusting the windings 4 of yarn 5 on the circumference of the rotary cage drum formed by the stable bolts 3.

The movement of the axially shiftable elements 6 is accomplished by a control disk 10 which engages by its edge 11 into a recess 12 of axially shiftable elements 6, and which is supported rotatably on a stable flange 13 so that its geometrical axis 14 is askew with respect to the rotation axis 15 of this control disk 10 and thus also with the rotation axis of the rotary cage drum, which consists of bodies 1 and 2 fixed on the shaft 16 by a feather key 17 and a screw 18. The control disk 10 is taken along by a bolt 19 inserted in the body 2 of the rotary cage drum. The shaft 16 is rotatably supported and axially secured in a holder 20 which is fixed by a screw 33 (FIG. 1) to the frame of a not shown textile machine, for instance of a knitting machine.

An arm 21 is provided with a guiding eyelet 22 for feeding yarn 5 to the rotary cage drum, and a take-off arm 23 with a guiding eyelet 24 is provided for the removal of the yarn 5 to the working system of a textile machine. A driven pulley 25 connected with the shaft 16 by means of a manually controlled coupling is freely rotatably supported on the upper part of the shaft 16. The manually controlled coupling is controlled by a hand wheel 26, in the opening of which a radial groove 27 is provided and in a transverse bore 28 of the shaft 16 at least two balls 29, spaced by a spring 30, are movably supported. The hand wheel 26 is slidably supported on the shaft 16 and is secured against turning by a feather key 31. The contact faces of the driven pulley 25 and of the hand wheel 26 are provided with radial indentments 32.

A perforated driving belt 46 bears on the driven pulley 25 which is provided with projections engaging into the holes in the belt.

Prior to starting the machine a certain number of windings 4 of yarn 5 is wound on the circumference of the cage drum with stable bolts 3 of the arrangement for feeding yarn according to this invention. By winding several windings 4 of yarn 5 on the rotary cage drum, the uncontrolled sliding of yarn 5 is prevented. In the course of depositing windings, the manually controlled coupling for disconnecting the driven pulley 25 from the shaft 16 by means of the axially slidable hand wheel 26 is advantageously used. In the course of the running of the machine, the cage drum rotates and takes along the axially shiftable elements 6, which bear by their lower faces 8 against the last winding 4 of yarn 5 in cooperation with the control disk 10, which shift the windings 4 of yarn 5 along the circumference of the feeding head, represented by the cage drum with the bolts 3 on its circumference. The last winding is led to the guiding eyelet 24 in the take-off arm 23 and further to the working system of a textile machine, for instance a knitting machine, a loom, or other machine. One winding 4 of yarn 5 is always formed for one revolution of the rotary cage drum and one winding is wound off.

Figure 4:
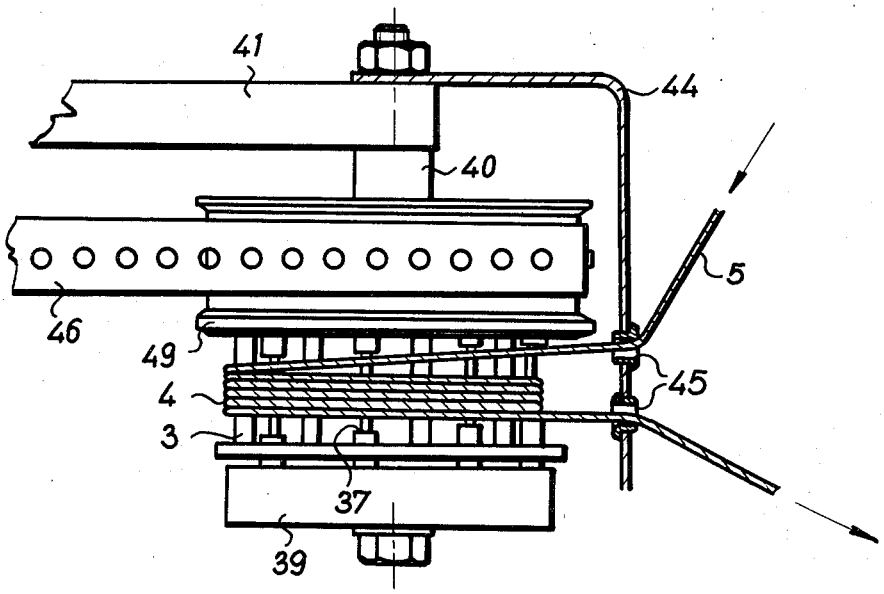
FIG. 4 is an overall elevation of a second arrangement of a cage drum.
Figure 5:
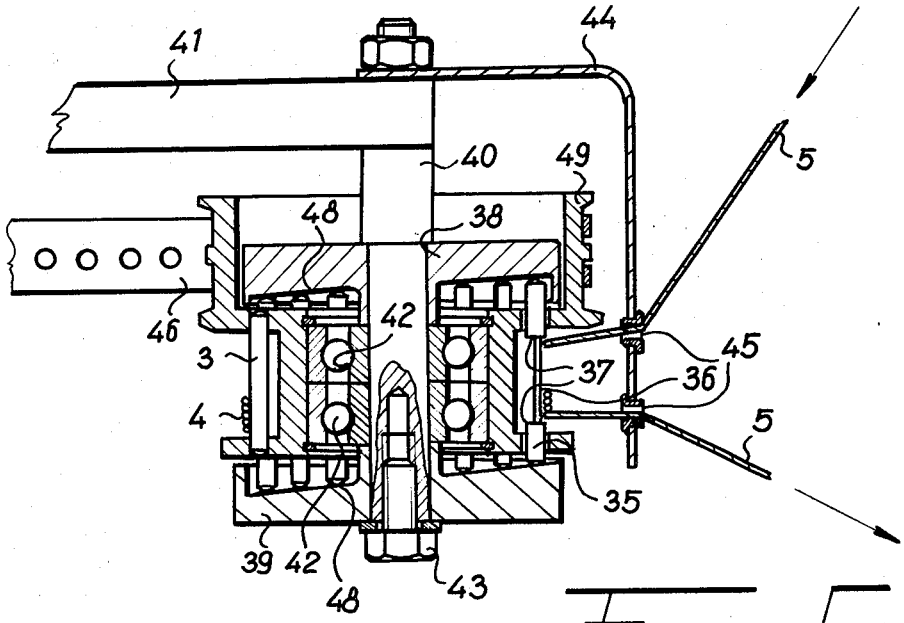
FIG. 5 is a sectional elevation of the arrangement of FIG. 4, in which the axially shiftable elements are controlled by a face cam.
Figure 6:
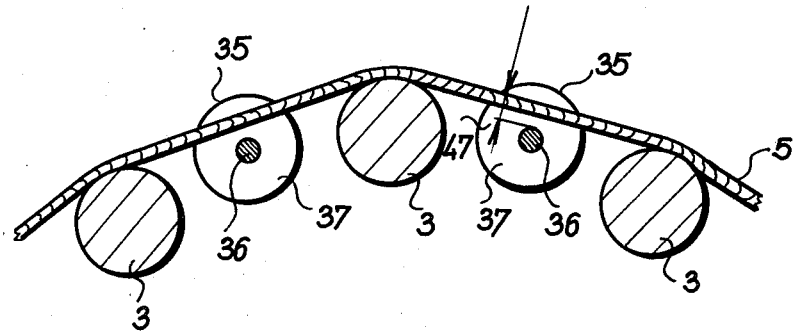
FIG. 6 is a top view of a detail of the mutual spatial arrangement of stable bolts of the cage drum and of axially shiftable rollers arranged therein, the view showing a throughgoing yarn cooperating therewith.

The axially shiftable elements can be also rollers 35, as shown in the embodiment of FIGS. 4, 5, 6. Rollers 35 are situated in gaps between stable bolts 3. The middle part 36 of axially shiftable elements, for instance of rollers 35, is recessed to a smaller diameter and thus faces 37 for distribution of yarn 5 are created on the rollers 35 on the circumference of the cage drum. The axially shiftable rollers 35, recessed in their middle part 36, are situated in the body part 49 of the cage drum so that a clearance 47 (FIG. 6) is created between the surface of the middle part 36 of the axially shiftable roller 35 and a connecting line of external surfaces of adjacent stable bolts 3 of the cage drum for guiding the yarn 5; thus the yarn does not contact the small diameter of the rollers 35 even in the course of their axial movement.

The rollers 35 bear by their extreme faces 48 on a stable face cam 38, 39 in order to accomplish an axial shifting of rollers 35. The face cam 38, 39 is composed of an internal and external part, which together with bearings 42 are fixed by a screw 43 to the bolt 40, which connection can be also secured by a not shown feather key. The bolt 40 is fixed by a holder 41 on the frame of a textile machine. A drawing-in device 44 with eyelets 45 for the supply of yarn 5 to the cage drum and for removal of yarn 5 to the working system of a textile machine is fixed to the holder 41. The body 1 of the cage drum is also driven by a perforated belt 46.

The feeding of yarn takes place in a manner similar to that in the earlier described arrangement. Prior to starting the machine, at least five windings 4 of yarn 5 are wound on the circumference of the cage drum. The number of windings is chosen as in the earlier case according to experience, according to the kind of yarn and the character of processing performed by the textile machine. The yarn 5 must not slip on the cage drum. The cage drum rotates in the course of the running of the machine, and takes along the rollers 35, which by the cooperation of their faces 37 on the recessed middle part 36 with the face cam 38, 39 shifts the windings of yarn 5 on the circumference of the drum, determined by stable bolts 3, and the last winding is led to the eyelet 45 of the drawing-in device 44 and further to the working system.

The arrangement according to this invention can be utilized on all types of circular knitting machines, on looms, and on other textile machines, wherein a constant feeding of yarn is required. It is especially advantageous on wale knitting machines. The arrangement according to this invention can be also utilized on a slipping basis by winding on one or two windings on the rotary cage drum with a simultaneous increase of the speed of revolution of the feeding head.

Although the invention is illustrated and described with reference to a plurality of preferred embodiments thereof, it is to be expressly understood that it is in no way limited to the disclosure of such preferred embodiments, but is capable of numerous modifications within the scope of the appended claims.

We claim:

1. Arrangement for the constant feeding of yarn to textile machines, comprising a rotatable cage drum supported on a driven rotatable member coaxially thereof, the circumference of the drum being formed by a number of spaced stable bolts parallel with the rotation axis of the drum, the drum being adapted for the deposition of a number of yarn windings, and elements on the drum shiftable in a direction axially of the drum, the shiftable elements being situated between said stable bolts, the axially shiftable elements being rollers, the middle part of the rollers being recessed to a smaller diameter so as to form faces of the rollers for guiding yarn along the circumference of the cage drum, and comprising a stable face cam firmly connected to a bolt on a holder adapted to be fixed to the frame of a textile machine, said rollers bearing with their extreme faces on said stable face cam.

2. An arrangement as claimed in claim 1, wherein a clearance for guiding the yarn is provided between the surface of the recessed middle part of the axially shiftable rollers and between a line connecting the external surfaces of adjacent stable bolts of the cage drum.

3. Arrangement for the constant feeding of yarn to textile machines, comprising a rotatable cage drum supported on a driven rotatable member coaxially thereof, the circumference of the drum being formed by a number of spaced stable bolts parallel with the rotation axis of the drum, the drum being adapted for the deposition of a number of yarn windings, and elements on the drum shiftable in a direction axially of the drum, the shiftable elements being situated between said stable bolts, the axially shiftable elements being straight and elongated, the middle part of the such elements being recessed so as to form faces on the elements for guiding yarns along the circumference of the cage drum, and comprising a stable face cam firmly connected to a bolt on a holder adapted to be fixed to the frame of a textile machine, said elements bearing with their extreme faces on said stable face cam.

4. An arrangement as claimed in claim 3, wherein a clearance for guiding the yarn is provided between the surface of the recessed middle part of the axially shiftable elements and between a line connecting the external surfaces of adjacent stable bolts of the cage drum.

* * * * *